US011186078B2

(12) United States Patent
Kemp et al.

(10) Patent No.: US 11,186,078 B2
(45) Date of Patent: Nov. 30, 2021

(54) PRINTING ASSEMBLY AND METHOD FOR PRINTING ON A FLEXIBLE SUBSTRATE

(71) Applicant: APEX BRANDS, INC., Apex, NC (US)

(72) Inventors: Benjamin David Kemp, Albury (AU); Graydon Alecander Carpenter, Albury (AU)

(73) Assignee: Apex Brands, Inc., Apex, NC (US)

( * ) Notice: Subject to any disclaimer, the term of this patent is extended or adjusted under 35 U.S.C. 154(b) by 318 days.

(21) Appl. No.: 16/088,751

(22) PCT Filed: Mar. 28, 2017

(86) PCT No.: PCT/US2017/024425
§ 371 (c)(1),
(2) Date: Sep. 26, 2018

(87) PCT Pub. No.: WO2017/172683
PCT Pub. Date: Oct. 5, 2017

(65) Prior Publication Data

US 2019/0308407 A1 Oct. 10, 2019

Related U.S. Application Data

(60) Provisional application No. 62/315,171, filed on Mar. 30, 2016.

(51) Int. Cl.
*B41F 13/10* (2006.01)
*B41F 33/00* (2006.01)
(Continued)

(52) U.S. Cl.
CPC ..... *B41F 13/10* (2013.01); *B41F 5/24* (2013.01); *B41F 13/24* (2013.01);
(Continued)

(58) Field of Classification Search
CPC .. B41F 13/10; B41F 5/24; B41F 13/24; B41F 33/0081; B41P 2227/11; B41P 2227/30
See application file for complete search history.

(56) References Cited

U.S. PATENT DOCUMENTS 3,162,117 A * 12/1964 Young ..... B41F 17/08 101/219
4,135,447 A 1/1979 Barnes et al.
(Continued)

FOREIGN PATENT DOCUMENTS

CN 103253022 A 8/2013
CN 103392194 A 11/2013
(Continued)

OTHER PUBLICATIONS

Office Action in related CN application No. 201780033269.1 dated Apr. 28, 2020, all pages herein cited in its entirety.
(Continued)

*Primary Examiner* — David H Banh
(74) *Attorney, Agent, or Firm* — Burr & Forman, LLP

(57) ABSTRACT

A printing assembly (400) may include a first continuous cylinder (420) and a first jogging assembly (424). The first continuous cylinder (420) may be configured to apply print media to a flexible substrate (300) responsive to contact with the flexible substrate. The first continuous cylinder (100, 420) may include a plurality of partitions (210, 220, 230, 240, 250, 260) configured such that only one of the partitions is aligned for contact with the flexible substrate at any given time, and each of the partitions may have a unique print characteristic associated therewith. The first jogging assembly (424) may be operably coupled with the first continuous cylinder (420) to move the first continuous cylinder along an axis thereof to change alignment of the partitions relative to the flexible substrate.

17 Claims, 4 Drawing Sheets

(51) Int. Cl.
*B41F 5/24* (2006.01)
*B41F 13/24* (2006.01)

(52) U.S. Cl.
CPC ..... *B41F 33/0081* (2013.01); *B41P 2227/11* (2013.01); *B41P 2227/30* (2013.01)

(56) References Cited

U.S. PATENT DOCUMENTS

| | | | | |
|---|---|---|---|---|
| RE30,324 | E * | 7/1980 | Seme | B21D 28/10 206/820 |
| 5,771,811 | A * | 6/1998 | Siler | B41F 13/14 101/181 |
| 7,222,435 | B1 | 5/2007 | Orfield | |
| 7,487,600 | B1 | 2/2009 | Cooper | |
| 2003/0019116 | A1 | 1/2003 | DeWall | |
| 2004/0071869 | A1 | 4/2004 | Gilliam | |
| 2006/0125899 | A1 * | 6/2006 | Cornish | B41J 3/407 347/104 |
| 2008/0168916 | A1 | 7/2008 | Li | |
| 2010/0165378 | A1 * | 7/2010 | Fujimori | H04N 1/233 358/1.15 |
| 2011/0155006 | A1 | 6/2011 | Pratt et al. | |
| 2013/0213249 | A1 * | 8/2013 | Yamamoto | C08G 18/10 101/395 |
| 2013/0311477 | A1 * | 11/2013 | Hecht | G07D 7/2075 707/740 |
| 2015/0052771 | A1 | 2/2015 | Mamatkhan | |
| 2015/0174601 | A1 * | 6/2015 | Lin | B05D 3/12 427/177 |
| 2017/0261300 | A1 | 9/2017 | Jost | |

FOREIGN PATENT DOCUMENTS

| | | | |
|---|---|---|---|
| DE | 2526921 | A1 | 12/1976 |
| EP | 1277574 | A1 | 1/2003 |
| EP | 1728629 | A2 | 12/2006 |
| EP | 2093059 | A2 | 8/2009 |
| JP | 09243301 | A | 9/1997 |
| JP | 2005279517 | A | 10/2005 |

OTHER PUBLICATIONS

International Search Report and Written Opinion of PCT/US2017/024425 dated Sep. 20, 2017, all enclosed pages cited.
Chapter I International Preliminary Report on Patentability of PCT/US2017/024425 dated Oct. 2, 2018, all enclosed pages cited.
Office Action in related U.S. Appl. No. 17/014,338 dated Sep. 30, 2020, all pages herein cited in its entirety.
Office Action in related CN application No. 201780033269.1 dated May 7, 2021, all pages herein cited in its entirety.
Office Action in related U.S. Appl. No. 17/014,338 dated Sep. 2, 2021, all pages herein cited in its entirety.

* cited by examiner

PRINTING ASSEMBLY AND METHOD FOR PRINTING ON A FLEXIBLE SUBSTRATE

CROSS REFERENCE TO RELATED APPLICATIONS

This application claims priority to U.S. 62/315,171 filed Mar. 30, 2016, the entire contents of which are incorporated by reference it its entirety.

TECHNICAL FIELD

Example embodiments generally relate to printing technology, and particularly relate to technology for printing measuring tape and other such products that employ a long flexible substrate.

BACKGROUND

Measuring tapes are typically printed using a conventional flexographic printing process. This type of printing process is also used to print on other flexible substrates like bread bags, product wrappers, and the like. In flexographic printing, the image is created by applying ink directly to a flexible printing plate, which is then brought into contact with stock to transfer the ink. The printing plate is a multi-layered, light sensitive flat (but flexible) sheet that is "exposed" and "developed" to create the printing plate. The printing plate is wrapped around a cylinder (or belt) for printing When placed on a press, an anilox roller transfers ink from an ink pan to the raised areas of the printing plate. An impression cylinder creates a light pressure between the substrate and the plate to allow the ink to transfer to the stock. The largest commercially available print plate is 50 by 80 inches. Thus, to print a 25 ft tape, four plates are needed, and three joins exist between the four plates. For metric tapes at 8 m, five plates with four joins placed every 2010 mm would be required.

As can be appreciated from the description above, relative to printing on longer flexible substrates such as measuring tapes, the length of the printing plate available has been the limiting factor. Moreover, the joins between the plates create gaps in the print. Traditionally, the joins are hidden in a non-print area between gradation marks. This means that it is impossible to print a solid color on a tape measure. Thus, traditional measuring tapes are surface painted (or powder coated) in a light color (e.g., yellow or white) that covers the entire surface of the measuring tape. Then, dark (typically black) gradations are printed on the measuring tape, and another dark color (typically red) is used to print the numbers.

Accordingly, it may be desirable to continue to develop improved mechanisms by which to implement printing on flexible substrates so that the problem of design and length limitation due to the need to hide joins can be overcome.

BRIEF SUMMARY OF SOME EXAMPLES

Some example embodiments may enable the provision of a device that allows printing without creating the need to hide joins, as described above. In this regard, some example embodiments may provide for the use of a continuous multilayered cylinder without joins in the printing process. Thus, a continuous repeating pattern can be provided to allow, for example, printing light numbers and gradations on a dark base layer.

In an example embodiment, a printing assembly is provided. The printing assembly may include a first continuous cylinder and a first jogging assembly. The first continuous cylinder may be configured to apply print media to a flexible substrate responsive to contact with the flexible substrate. The first continuous cylinder may include a plurality of partitions configured such that only one of the partitions is aligned for contact with the flexible substrate at any given time, and each of the partitions may have a unique print characteristic associated therewith. The first jogging assembly may be operably coupled with the first continuous cylinder to move the first continuous cylinder along an axis thereof to change alignment of the partitions relative to the flexible substrate.

In another example embodiment, a method of printing on a flexible substrate is provided. The method may include moving a flexible substrate proximate to a continuous cylinder and applying print media to the flexible substrate responsive to contact between the continuous cylinder and the flexible substrate. The continuous cylinder may include a plurality of partitions configured such that only one of the partitions is aligned for contact with the flexible substrate at any given time, and each of the partitions has a unique print characteristic associated therewith. The method may further include determining when a first partition of the continuous cylinder has fully applied print media to the flexible substrate, and moving the continuous cylinder along an axis thereof to align a second partition of the continuous cylinder with the flexible substrate.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
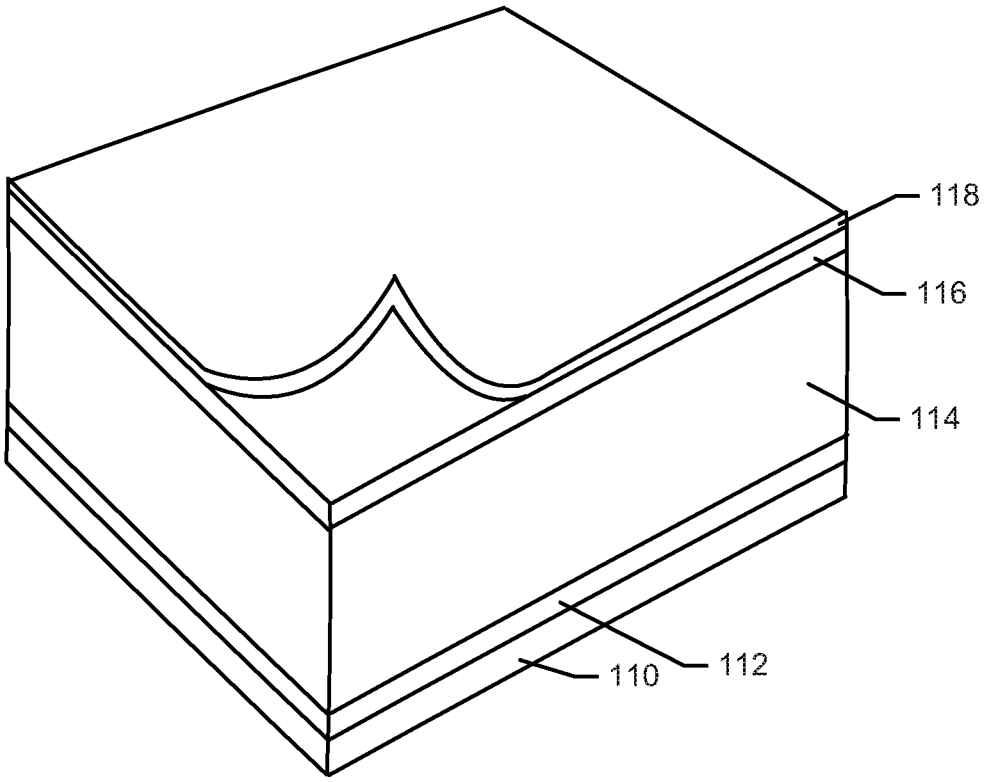
FIG. 1 illustrates a cross section of materials used to form such a cylinder in accordance with an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of a device that allows printing without creating the need to hide joins so that, for example, printing light numbers and gradations on a dark base layer becomes possible. This is accomplished by employing a continuous multilayered cylinder without joins. FIG. 1 illustrates a cross section of materials used to form such a cylinder in accordance with an example embodiment.

As shown in FIG. 1, a cylinder 100 (see FIG. 2) of an example embodiment may include a base layer 110, which may be a polyester film or a metallic material in some cases. An adhesive and anti-halation layer 112 may bind the base layer 110 to a photosensitive polymer layer 114. A laser ablation layer 116 may be provided on the photosensitive polymer layer 114. In some cases, a protective cover film 118 (e.g., a polyester film) may be provided on top of the laser ablation layer 116.

Laser ablation is a process of removing material from a solid (or occasionally liquid) surface by irradiating the material with a laser beam. At low laser flux, the material is heated by the absorbed energy from the laser, and the material evaporates or sublimates. Of note, in some cases, other processes could be employed instead of laser ablation. For example, laser engraving or chemical etching may be employed to replace the laser ablation layer with a corresponding layer dependent upon the removal process employed. However, laser ablation may be preferred for some applications. When laser ablation is employed, an image can be lasered onto the surface of the cylinder 100. The cylinder 100 is created as a continuous cylinder sleeve with no joins. Thus, the cylinder 100 is essentially a solid print cylinder (i.e., having no joins). When printing with such a cylinder, the limitation on printing becomes the capability of the laser ablation process to image the cylinder and the length of the "repeat" on, for example, a tape measure.

On an 8 m measuring tape, the repeat may occur, for example, in increments of 10 cm. On a 25 ft measuring tape, the repeat occurs in 12 inch increments. To overcome the repeat length issue, the cylinder 100 may be partitioned. Thus, for example, the cylinder 100 may be a continuous cylinder with repeat lengths broken down into multiple partitions of a given length (e.g., 1 m, 1 ft, etc.). The cylinder 100 could then be axially moved (e.g., jogged) to use corresponding different partitions at appropriate times to access each respective section (e.g., meter) of print so that a full and unique (e.g., 8 m) length of measuring tape can be created. This concept can be applied to any desirable length of tape, and can be used for metric or imperial tapes.

Figure 2:
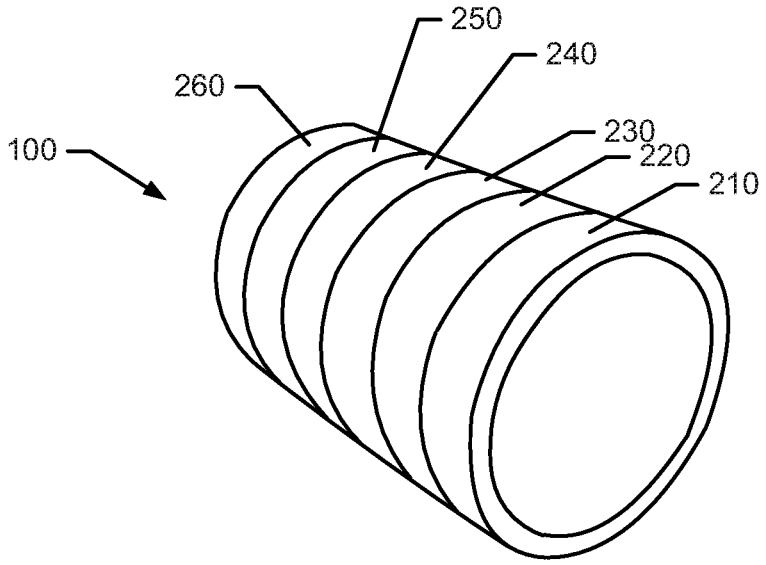
FIG. 2 illustrates a perspective view of the cylinder and corresponding partitions provided thereon according to an example embodiment.

FIG. 2 illustrates a perspective view of the cylinder 100 and corresponding partitions provided thereon. The partitions include a first partition 210, a second partition, 220, a third partition 230, a fourth partition 240, a fifth partition 250, and a sixth partition 260. However, it should be appreciated that any desirable number of partitions may be employed in various example embodiments. Each of the partitions may have a unique set of numbers (or gradations, or other symbols). Thus, for example, the first partition 210 may be printed with a sequence of numbers (e.g., 0, 10, 20, 30, 40, 50, 60, 70, 80, 90), the second partition 220 may be printed with a different (sequentially incremented) sequence of numbers (e.g., 100, 110, 120, 130, 140, 150, 160, 170, 180, 190), the third partition 230 may be printed with a different (sequentially incremented) sequence of numbers (e.g., 200, 210, 220, 230, 240, 250, 260, 270, 280, 290), etc. This sequence can be repeated for any desired number of partitions. After one partition has been fully printed, a jog or axial movement of the cylinder 100 may be performed in order to align the next partition for printing. After the next partition has been fully printed, another jog occurs and so on until the full sequence of numbers is printed. For a cylinder having a 1 m circumference, the first meter (e.g., 100 cm) of printing can be accomplished before the jog to the second meter (e.g., centimeter gradations 100 to 200) is performed. Then, a jog to the third meter (e.g., centimeter gradations 200 to 300) is performed, and so on for the full length of printing on the corresponding measuring tape.

By using this process, or combination of processes, a unique capability is provided relative to enabling the creation of a continuous solid print design with changing features over the length of the design. Moreover, the partitioning and jogging of the continuous cylinders allows repeat lengths to be printed that are greater than the circumference of the largest available cylinder. As such, there is no theoretical limit to the length that can be printed.

Figure 3:
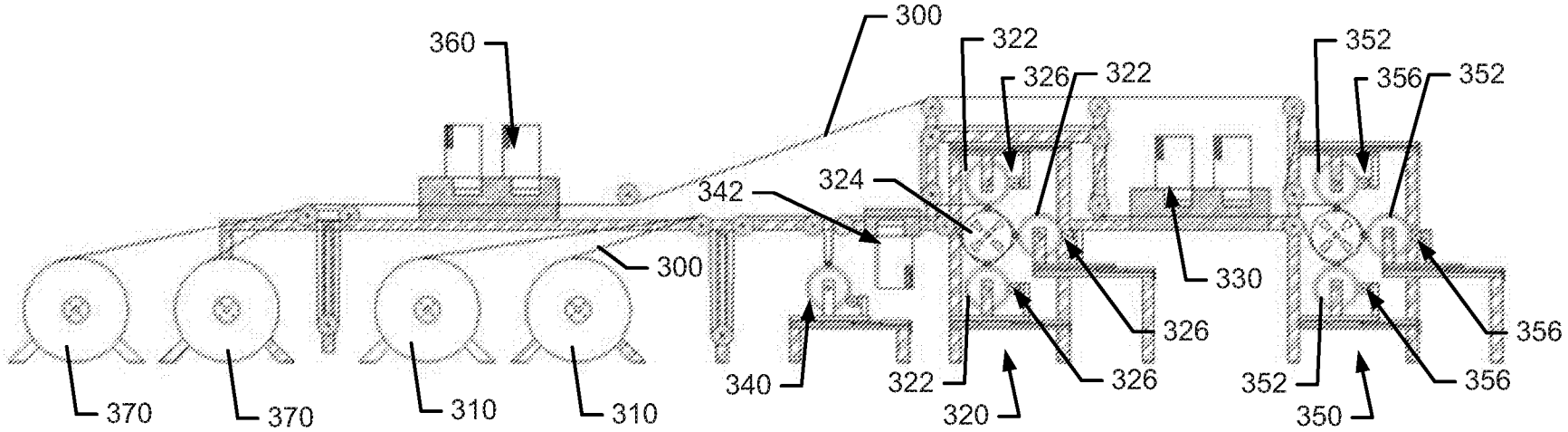
FIG. 3 illustrates a conceptual diagram showing various components of a system for printing in accordance with an example embodiment.

FIG. 3 illustrates a conceptual diagram showing various components of a system for printing in accordance with an example embodiment. Referring to FIG. 3, one or more rolls of a flexible substrate 300 may originate from one or more feed rolls 310. In some cases, the system of FIG. 3 may be configured to process and print on multiple flexible substrates in parallel simultaneously.

As shown in FIG. 3, the flexible substrate 300 (or each instance thereof) may be passed through a series of powered and unpowered rollers to a first print assembly 320. The first print assembly 320 may include one or more continuous cylinders (e.g., print cylinders) of a first set of continuous cylinders 322. The first set of continuous cylinders 322 may be configured to contact (and print on) a first side of the flexible substrate 300, while an impression cylinder 324 contacts the opposite side of the flexible substrate 300. The continuous cylinders may have print medium (e.g., ink) transferred thereon by a media applicator 326 immediately before the continuous cylinders roll to the point where the flexible substrate 300 is pressed between each continuous cylinder of the first set of continuous cylinders 322 and the impression cylinder 324. Thus, at the point where the flexible substrate 300 is pressed between each continuous cylinder of the first set of continuous cylinders 322 and the impression cylinder 324, the print medium is transferred to the first side of the flexible substrate 300.

After the print medium has been transferred to the flexible substrate 300, one or more UV dryers 330 may be provided to dry the print medium on the flexible substrate 300. Thus, for example, the ink applied at the first set of continuous cylinders 322 may be dried on the flexible substrate 300 by the UV dryers 330. In some cases, the first set of continuous cylinders 322 may apply print medium to define print applied directly to the flexible substrate 300. However, in other cases, the first print assembly 320 may actually apply the print over the top of a base print layer applied by a base roller 340 and corresponding UV dryer 342. The base print layer could be a continuous base color or an initial pattern. In some cases, the base roller 340 may provide gradations and the other continuous cylinders may apply number sequences that need to change (e.g., via jogging to different partitions) based on location.

In cases where it is desirable to print on both sides of the flexible substrate 300, a second print assembly 350 may be provided. The second print assembly 350 may operate similarly to the first print assembly 320, except that the second print assembly 350 places continuous cylinders of a second set of continuous cylinders 352 into contact with the opposite side of the flexible substrate 300 to that which was printed on by the first set of continuous cylinders 322.

Thus, for example, the second set of continuous cylinders 352 may be configured to contact (and print on) a second side of the flexible substrate 300 (opposite the first side), while an impression cylinder 354 contacts the opposite side of the flexible substrate 300 (i.e., the first side). Each of the continuous cylinders may have print medium (e.g., ink) transferred thereon by a media applicator 356 immediately before the continuous cylinders roll to the point where the flexible substrate 300 is pressed between each continuous cylinder of the second set of continuous cylinders 352 and the impression cylinder 354. Thus, at the point where the flexible substrate 300 is pressed between each continuous cylinder of the second set of continuous cylinders 352 and the impression cylinder 354, the print medium is transferred to the second side of the flexible substrate 300.

After the print medium has been transferred to the second side of the flexible substrate 300 by the second print assembly 350, one or more UV dryers 360 may be provided to dry the print medium on the flexible substrate 300. Thus, for example, the ink applied at the second set of continuous cylinders 352 may be dried on the flexible substrate 300 by the UV dryers 360. The flexible substrate 300 may then be provided to finish rolls 370 on which the finished product is collected.

As can be appreciated from FIG. 3 in the context of the discussion above, either or both of the first and second sides of the flexible substrate 300 can be printed with corresponding different patterns that repeat. The multiple cylinders of the first and second sets of continuous cylinders 322 and 352 may provide different repeatable patterns, the same repeatable patterns or combinations thereof. Moreover, if the patterns repeat at different intervals, corresponding ones of the continuous cylinders may have different sizes (i.e., different circumferences or perimeters) and therefore may need jogging at corresponding different intervals.

Some or all of the continuous cylinders may include partitions that have unique patterns (e.g., gradations and/or number sequences) provided thereon. Thus, the cylinders may be jogged at corresponding appropriate times to cycle to a next partition at the appropriate time. In some cases, one or more cylinders may be used for printing gradations, and another one or more different cylinders can be used to print number sequences in a same or different color. However, in other cases, the same cylinders could be used to print both gradations and number sequences (e.g., in the same color). The jogging may occur along the axial direction of each of the continuous cylinders (i.e., into or out of the page for FIG. 3). In an example embodiment, the jogging may be accomplished using a geared drive assembly or servo to axially adjust the alignment of the continuous cylinders so that a selected one of the partitions is aligned with the flexible substrate 300.

Example embodiments may enable continuous printing to be achieved with multiple colors on single or double sided tapes. Thus, for example, three color printing can be performed even in situations where the base color is a darker color than the colors printed thereon via inline printing. Inline powder coating and/or inline clear coating may be expansion possibilities by employing the technology described herein. Example embodiments may also enable single minute exchange of dies (SMED) to be achieved, which would eliminate significant press downtime. Costly photopolymer belt replacement may also be eliminated by employing example embodiments.

Figure 4:
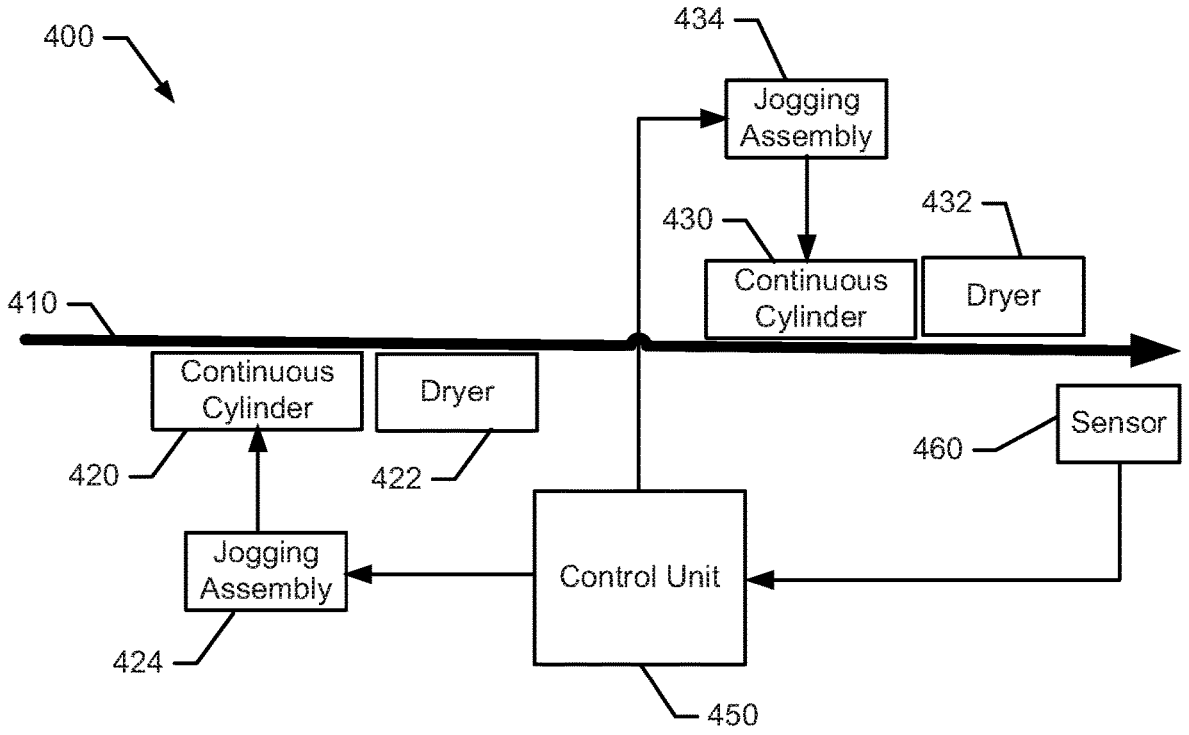
FIG. 4 is a block diagram of a system for printing in accordance with an example embodiment.

FIG. 4 is a block diagram of a system for printing in accordance with an example embodiment. FIG. 4 shows a press or printing assembly 400 that may be used to print on any length of flexible substrate 410 one or more sides thereof. The printing assembly 400 includes a first continuous cylinder 420. As discussed above, the first continuous cylinder 420 is divided into a plurality of partitions. Only one of the partitions is aligned for contact with the flexible substrate 410 at any given time, and each of the partitions has a unique print characteristic associated therewith (e.g., a unique number set or sequence, a unique design, and/or the like).

While any given one of the partitions is aligned with the flexible substrate 410, the corresponding unique print characteristic associated therewith can be applied to the flexible substrate 410 by contact between the flexible substrate 410 and the first continuous cylinder 420. Of note, the first continuous cylinder 420 may be one of a plurality of such cylinders that may print respective different colors or designs on the same side of the flexible substrate 410. Color print applied to the flexible substrate 410 may be dried by a first dryer 422.

When the entire perimeter or circumference of a particular one of the partitions of the first continuous cylinder 420 has been used for printing, a jogging assembly 424 may be used to shift the position (and therefore alignment) of the first continuous cylinder 420 axially so that a next partition is aligned with the flexible substrate 410. The next partition may then print its own unique print characteristic upon the flexible substrate 410. When the next partition has been completely traversed, then still another partition may be aligned and used for printing.

Transitioning between each partition is mechanically conducted by the jogging assembly 424. The jogging assembly 424 may be embodied as a gear set, servo, electric motor, or any other such suitable device for translating the position of the first continuous cylinder 420 axially. In an example embodiment, each partition of the first continuous cylinder 420 may be similar in size and therefore have the same perimeter or circumference. Moreover, the width of the flexible substrate 410 may substantially match the width of each partition. Thus, the jogging assembly 424 may apply an axial movement to the first continuous cylinder 420 that is the same (e.g., substantially equal to the width of the partitions) for each partition transition. The first continuous cylinder 420 may therefore have the ability to repeat printing with each new partition by sequentially moving to adjacent partitions in a single direction until the full complement of partitions has been cycled through completely. At that point, the full length of the flexible substrate 410 should have been printed.

If both sides of the flexible substrate 410 are to be printed on, the printing assembly 400 may include a second continuous cylinder 430 (or multiple instances thereof), a second dryer 432, and a second jogging assembly 434, which may operate similar to the corresponding components described above, but do so relative to the opposite side of the flexible substrate 410. In some cases, the diameter of the second continuous cylinder 430 (and therefore also the perimeter or circumference thereof) may be different from the diameter of the first continuous cylinder 420. Accordingly, different jogging times may be needed for respective ones of the first continuous cylinder 420 and the second continuous cylinder 430. Furthermore, the number of partitions of the second continuous cylinder 430 may be different from the number of partitions of the first continuous cylinder 420. Accordingly, a different number of jogging operations may be performed for respective ones of the first continuous cylinder 420 and the second continuous cylinder 430 to cycle through all partitions.

In an example embodiment, a control unit 450 may be operably coupled to each of the first jogging assembly 424 and the second jogging assembly 434 in order to control the timing and implementation of the jogging activities. Thus, for example, the control unit 450 may be aware of the number of partitions, width of partitions, speed of motion of the flexible substrate 410, perimeter or circumference of the partitions, etc., in order to enable the control unit 450 to manage jogging activities. In an example embodiment, the printing assembly 400 may include one or more instances of a sensor 460 to facilitate the operation of the control unit 450.

The sensor 460 (or sensors) may detect the speed of motion of the flexible substrate 410. In this regard, the sensor 460 may read the speed at which partitions pass the sensor 460 to determine such speed, or may determine the speed of one or more rollers or cylinders to determine such speed. In some cases, the sensor 460 may also detect location information and be able to determine or infer location proximate to other components of the printing assembly 400. Thus, based on the location information and/or speed information provided by the sensor 460, the control unit 450 may intelligently direct the initiation of jogging activity. The sensor 460 may be an optical sensor in some cases.

In an example embodiment, the control unit 450 may be a programmable logic controller (PLC), field programmable gate array (FPGA), or other processing circuitry capable of intelligently controlling the jogging activity. As such, in some cases, the control unit 450 may include processing circuitry such as a processor and memory. The memory may store instructions and/or data (e.g., information descriptive of the circumference of each partition and number of partitions of each cylinder) along with instructions for triggering the jogging activity.

Figure 5:
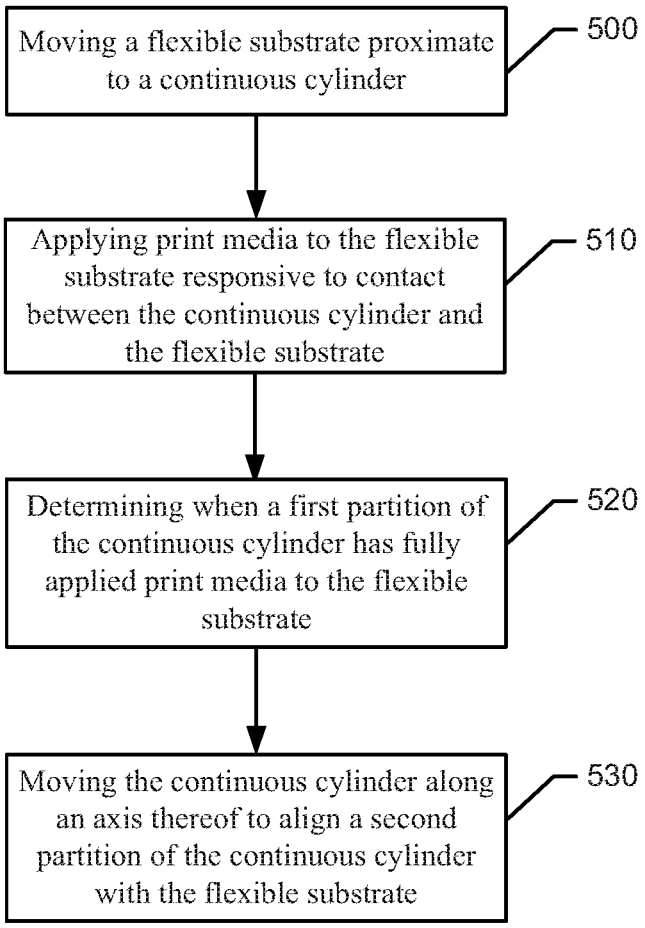
FIG. 5 illustrates a method of printing on a flexible substrate in accordance with an example embodiment.

FIG. 5 illustrates a method of printing on a flexible substrate in accordance with an example embodiment. As shown in FIG. 5, the method of printing on a flexible substrate may include moving a flexible substrate proximate to a continuous cylinder at operation 500 and applying print media to the flexible substrate responsive to contact between the continuous cylinder and the flexible substrate at operation 510. The continuous cylinder may include a plurality of partitions configured such that only one of the partitions is aligned for contact with the flexible substrate at any given time, and each of the partitions has a unique print characteristic associated therewith. The method may further include determining when a first partition of the continuous cylinder has fully applied print media to the flexible substrate at operation 520, and moving the continuous cylinder along an axis thereof to align a second partition of the continuous cylinder with the flexible substrate at operation 530.

In some cases, the method (or portions or operations thereof) may be augmented or modified, or additional optional operations may be included. For example, in some cases, the first continuous cylinder may include a circumference having a laser ablated surface that defines the unique print characteristic of each of the partitions. In an example embodiment, the unique print characteristic may define a unique number set or sequence for each of the partitions. In some cases, the unique number set of each partition sequentially follows a number set of a preceding adjacent partition. In an example embodiment, moving the continuous cylinder may be performed via a control unit operably coupled to a jogging assembly. In some cases, the control unit stores information indicative of a circumference of the continuous cylinder, and the control unit determines location information regarding the flexible substrate to determine when to trigger the jogging assembly to adjust alignment of the continuous cylinder relative to the flexible substrate. In an example embodiment, the method may further include employing a sensor to determine a speed of the flexible substrate. In some cases, applying the print media to the flexible substrate may include printing a base layer on the flexible substrate. The base layer may be a dark color, and printing gradations or numbers over the base layer may include printing the gradations or numbers in a color that is lighter than the dark color of the base layer.

By using the continuous cylinders of an example embodiment, continuous unique or non-repeating patterns can be printed with virtually any combination of colors and in any desirable length. Thus, for example, example embodiments may allow a solid black area to be printed with the base layer showing through as the gradations. Of note, the base layer could be any color.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A measuring tape printing assembly comprising:

a first continuous cylinder configured to apply print media to a flexible substrate responsive to contact with the flexible substrate, the first continuous cylinder comprising a plurality of partitions configured such that only one of the partitions is aligned for contact with the flexible substrate at any given time, and each of the partitions has a unique print characteristic associated therewith, the plurality of partitions comprising a first partition and a second partition;

a first jogging assembly operably coupled with the first continuous cylinder to move the first continuous cylinder along an axis thereof to change alignment of the first continuous cylinder relative to the flexible substrate from an alignment with the first partition for printing on the flexible substrate to an alignment with the second partition for printing on the flexible substrate; and a control unit operably coupled to the first jogging assembly to control the first jogging assembly;

wherein the control unit is configured to:

store information indicative of a circumference of the first continuous cylinder;

determine location information regarding the flexible substrate; and control a timing for triggering the first jogging assembly, based on the circumference and the location information, to move the first continuous cylinder along the axis from the alignment of the first partition with the flexible substrate to the alignment of the second partition with the flexible substrate when the first partition of the continuous cylinder has fully applied print media to the flexible substrate.

2. The printing assembly of claim 1, wherein the first continuous cylinder is a laser ablated, laser engraved, or chemical etched surface that defines the unique print characteristic of each of the partitions.

3. The printing assembly of claim 2, wherein the unique print characteristic defines a unique number set or sequence for each of the partitions.

4. The printing assembly of claim 3, wherein the unique number set of each partition sequentially follows a number set of a preceding adjacent partition.

5. The printing assembly of claim 1, wherein the control unit is operably coupled to a sensor that determines speed of the flexible substrate.

6. The printing assembly of claim 5, further comprising a second continuous cylinder and a second jogging assembly.

7. The printing assembly of claim 1, further comprising a second continuous cylinder and a second jogging assembly.

8. The printing assembly of claim 1, wherein the print assembly is configured to print a base layer on the flexible substrate, the base layer having a dark color, and wherein the print assembly is configured to print gradations or numbers over the base layer, the gradations or numbers being printed in a color that is lighter than the dark color of the base layer.

9. The printing assembly of claim 8, wherein the flexible substrate is a measuring tape and a circumference of each partition of the first continuous cylinder is one meter and each partition sequentially increases count by one hundred centimeter increments.

10. The printing assembly of claim 8, wherein the flexible substrate is a measuring tape and a circumference of each partition of the first continuous cylinder is one foot and each partition sequentially increases count by twelve inch increments.

11. A method of printing on a flexible substrate, the method comprising:

storing, at a control unit, information indicative of a circumference of the continuous cylinder;

moving a flexible substrate proximate to a continuous cylinder;

determining, at the control unit, location information regarding the flexible substrate;

applying print media to the flexible substrate responsive to contact between the continuous cylinder and the flexible substrate, the continuous cylinder comprising a plurality of partitions configured such that only one of the partitions is aligned for contact with the flexible substrate at any given time, and each of the partitions has a unique print characteristic associated therewith, the plurality of partitions comprising a first partition and a second partition;

determining when a first partition of the continuous cylinder has fully applied print media to the flexible substrate; and controlling, via the control unit, a timing for triggering the first jogging assembly, based on the circumference and the location information, to move the continuous cylinder along an axis thereof from an alignment of the first partition with the flexible substrate to an alignment of the second partition with the flexible substrate when the first partition of the continuous cylinder has fully applied print media to the flexible substrate, the control unit being operably coupled to the first jogging assembly to control the first jogging assembly.

12. The method of claim 11, wherein the continuous cylinder comprises a laser ablated, laser engraved, or chemical etched surface that defines the unique print characteristic of each of the partitions.

13. The method of claim 12, wherein the unique print characteristic defines a unique number set or sequence for each of the partitions.

14. The method of claim 13, wherein the unique number set of each partition sequentially follows a number set of a preceding adjacent partition.

15. The method of claim 11, wherein moving the continuous cylinder is performed via a control unit operably coupled to a jogging assembly.

16. The method of claim 11, further comprising employing a sensor to determine a speed of the flexible substrate.

17. The method of claim 11, wherein applying the print media to the flexible substrate comprises printing a base layer on the flexible substrate, the base layer having a dark color, and printing gradations or numbers over the base layer, the gradations or numbers being printed in a color that is lighter than the dark color of the base layer.

* * * * *